US011472177B2

(12) United States Patent
Eto

(10) Patent No.: US 11,472,177 B2
(45) Date of Patent: Oct. 18, 2022

(54) LIQUID EJECTION DEVICE AND INKJET RECORDING APPARATUS

(71) Applicant: KYOCERA Document Solutions Inc., Osaka (JP)

(72) Inventor: Daisuke Eto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/132,770

(22) Filed: Dec. 23, 2020

(65) Prior Publication Data

US 2021/0187945 A1 Jun. 24, 2021

(30) Foreign Application Priority Data

Dec. 23, 2019 (JP) ..... JP2019-231185

(51) Int. Cl.
*B41J 2/045* (2006.01)
*B41J 2/135* (2006.01)

(52) U.S. Cl.
CPC ..... *B41J 2/04515* (2013.01); *B41J 2/135* (2013.01)

(58) Field of Classification Search
CPC .. B41J 2/0456; B41J 2/04581; B41J 2/04515; B41J 2/135
See application file for complete search history.

(56) References Cited

U.S. PATENT DOCUMENTS

2015/0360462 A1* 12/2015 Lowrance ..... B41J 25/304 101/425
2020/0198325 A1* 6/2020 Kollata ..... G01B 11/285

FOREIGN PATENT DOCUMENTS

JP 2013-226706 A 11/2013

* cited by examiner

*Primary Examiner* — Thinh H Nguyen
(74) *Attorney, Agent, or Firm* — Hawaii Patent Services; Nathaniel K. Fedde; Kenton N. Fedde

(57) ABSTRACT

Provided is a liquid ejection device capable of improving the sealing property of a gap between a main housing and a liquid ejection head while maintaining a position adjustment allowance of the liquid ejection head with respect to the main housing. A main housing has one or more ejection unit protrusion opening into which the liquid ejection unit is inserted downward and protrudes through a gap in a horizontal direction, and covers and internally houses a portion of the liquid ejection head other than the liquid ejection unit. The size of the ejection unit insertion opening is smaller than the size of the ejection unit protrusion opening. The sealing member comes in contact with the outer peripheral portion of the liquid ejection unit in a state where the edge portion of the ejection unit insertion opening is bent.

8 Claims, 13 Drawing Sheets

LIQUID EJECTION DEVICE AND INKJET RECORDING APPARATUS

INCORPORATION BY REFERENCE

This application is based on and claims the benefit of priority from Japanese Patent Application No. 2019-231185 filed on Dec. 23, 2019, the contents of which are hereby incorporated by reference.

BACKGROUND

The present disclosure relates to a liquid ejection device and inkjet recording apparatus The inkjet recording apparatus includes a liquid ejection device that ejects ink (liquid) onto a recording medium such as paper or the like. Liquid ejection devices may circulate air internally for a variety of reasons. For example, when a liquid ejection device includes a control board that controls the operation related to the ejection of the liquid, air may be circulated inside to cool the control board in order to obtain a specified performance.

A typical liquid ejection device includes a drive circuit board that drives an inkjet head, a heat sink that dissipates heat generated by the drive circuit board, a housing that houses the drive circuit board and the heat sink inside thereof, and a fan motor that generates air flow inside the housing. As a result, the heat generated in the drive circuit board may be dissipated through the heat sink. Furthermore, the heat sink may be cooled by the fan motor, and thus it is possible to improve the cooling effect of the drive circuit board.

SUMMARY

The liquid ejection device according to the present disclosure includes: one or more liquid ejection head having a liquid ejection unit that ejects liquid onto a recording medium; a main housing having one or more ejection unit protrusion opening into which the liquid ejection unit is inserted downward and protrudes through a gap in a horizontal direction, and covers and internally houses a portion of the liquid ejection head other than the liquid ejection unit; one or more sealing member having an ejection unit insertion opening into which the liquid ejection unit is inserted, and that comes in contact with an outer peripheral portion of the liquid ejection unit to close the gap in the horizontal direction; and a fan that allows air to flow between the main housing and the liquid ejection head; a size of the ejection unit insertion opening being smaller than a size of the ejection unit protrusion opening; and the sealing member comes in contact with a outer peripheral portion of the liquid ejection unit in a state where an edge portion of the ejection unit insertion opening is bent.

DETAILED DESCRIPTION

Hereinafter, embodiments according to the present disclosure will be described with reference to the drawings. Note that the technique according to the present disclosure is not limited to the following contents.

Figure 1:
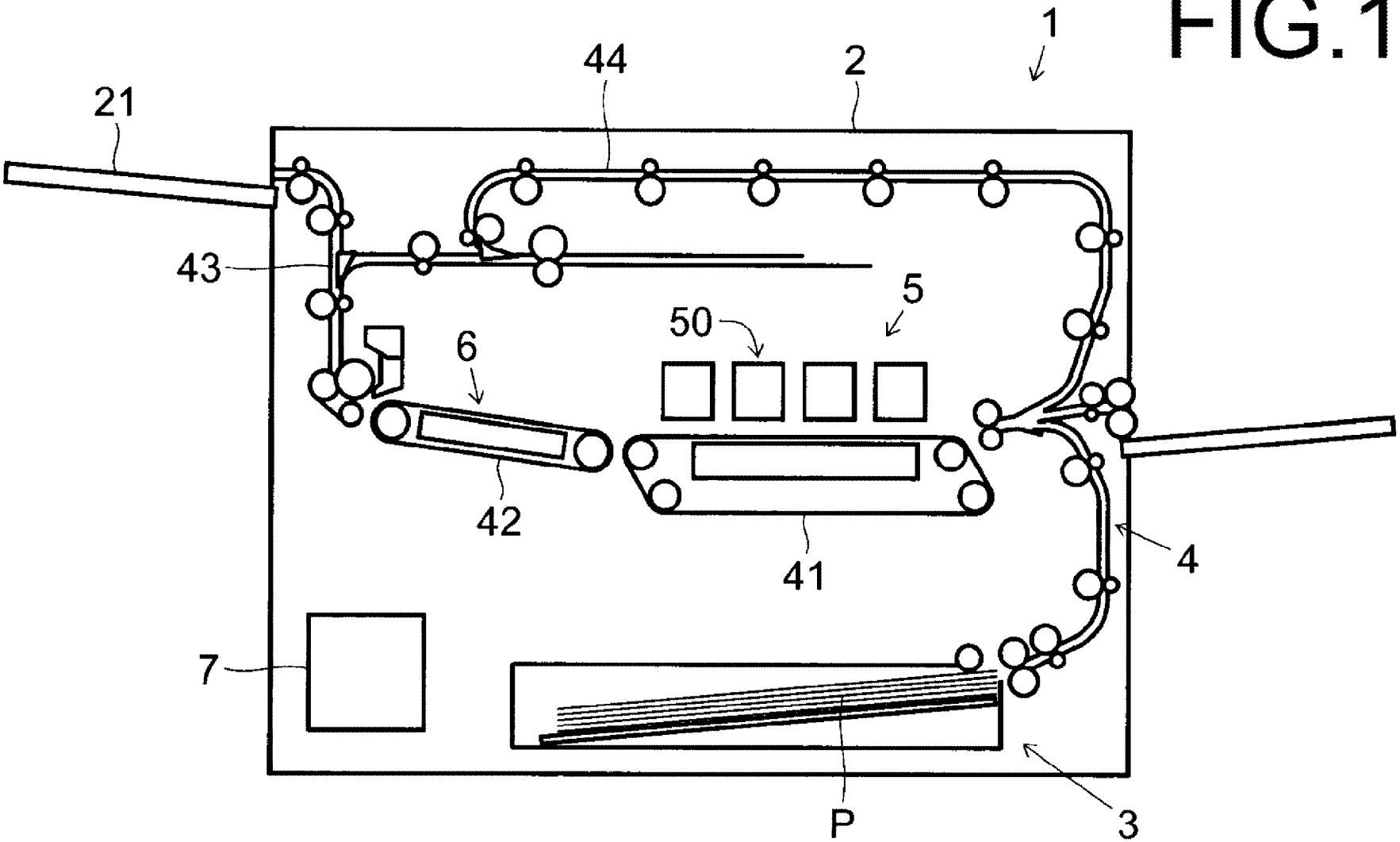
FIG. 1 is a cross-sectional view illustrating a schematic configuration of an inkjet recording apparatus of an embodiment according to the present disclosure.
Figure 2:
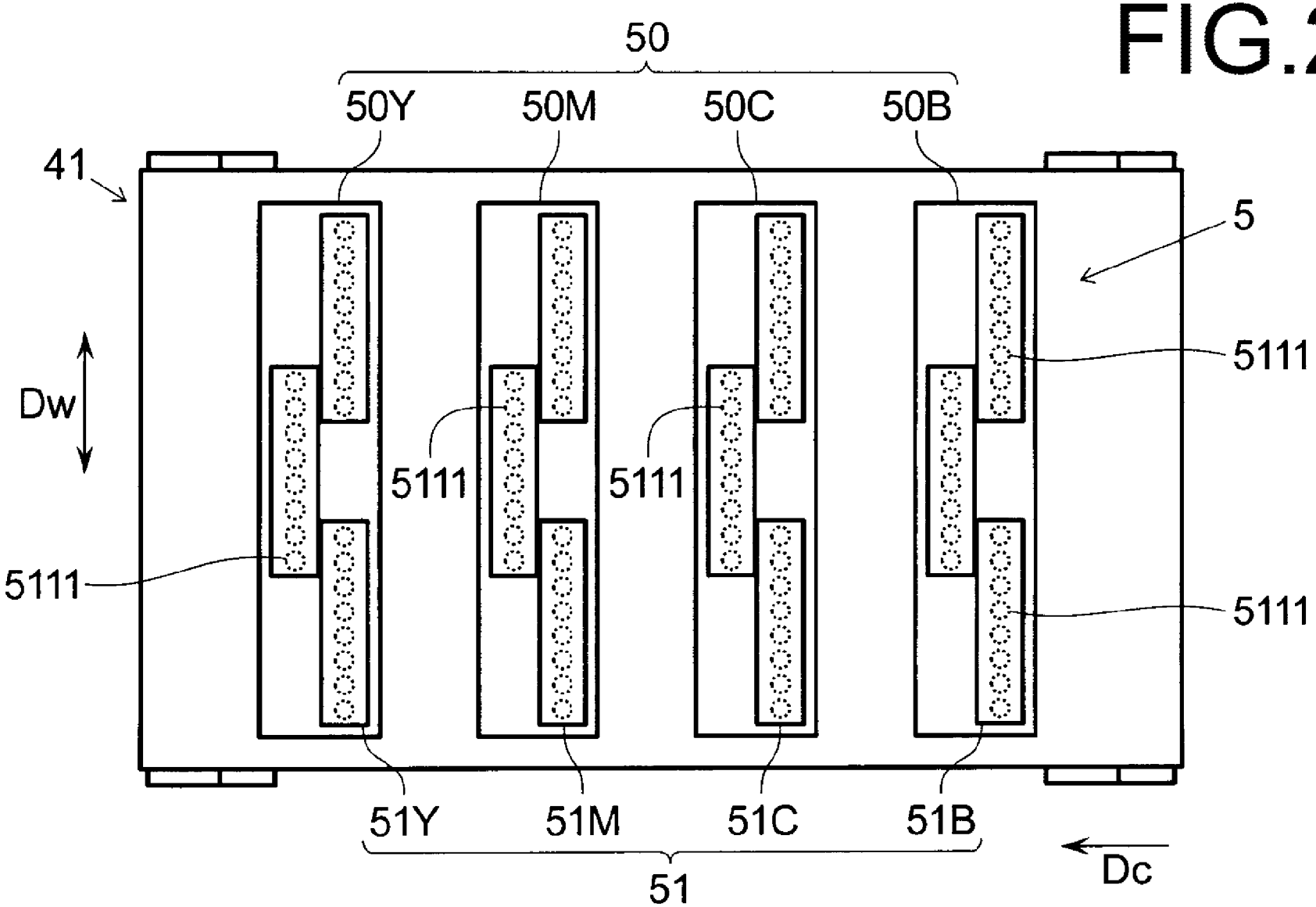
FIG. 2 is a plan view of the recording unit of the inkjet recording apparatus in FIG. 1.
Figure 3:
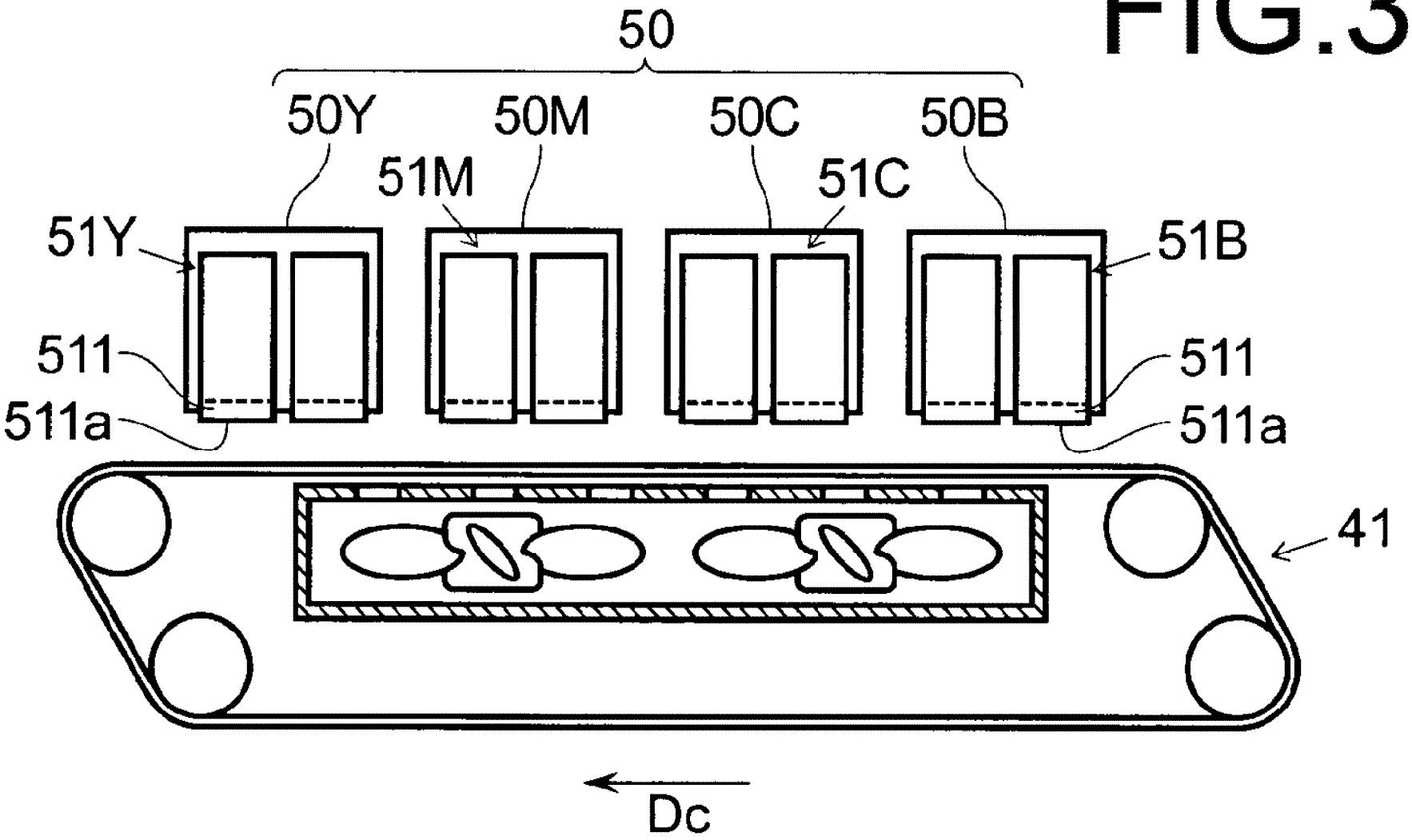
FIG. 3 is a schematic configuration diagram illustrating the surroundings of the recording unit of the inkjet recording apparatus in FIG. 1.

FIG. 1 is a cross-sectional view illustrating a schematic configuration of an inkjet recording apparatus 1 of an embodiment. FIG. 2 is a plan view of the recording unit 5 of the inkjet recording apparatus 1 in FIG. 1. FIG. 3 is a schematic configuration diagram illustrating the surroundings of the recording unit 5 of the inkjet recording apparatus 1 in FIG. 1. The inkjet recording apparatus 1 is, for example, an inkjet recording type printer. As shown in FIGS. 1, 2 and 3, the inkjet recording apparatus 1 includes a paper supply unit 3, a paper conveying unit 4, a recording unit 5, a drying unit 6, and an overall control unit 7.

The paper supply unit 3 accommodates a plurality of sheets of paper (recording medium) P, and separates and feeds out the paper P one sheet at a time at the time of recording. The paper conveying unit 4 conveys the paper P fed from the paper supply unit 3 to the recording unit 5 and the drying unit 6, and further discharges the paper P after recording and drying to the paper discharge unit 21. In a case where double-sided recording is performed, the paper conveying unit 4 distributes the paper P after recording and drying on the first surface to a reverse conveying unit 44 by a branching unit 43. In this case, the paper conveying unit 4 further switches the conveying direction and conveys the paper P, the front and back sides of which are reversed, to the recording unit 5 and the drying unit 6 again.

The paper conveying unit 4 has a first belt conveying unit 41 and a second belt conveying unit 42. The first belt conveying unit 41 and the second belt conveying unit 42 attract and hold the paper P on the upper surface of a continuous belt and convey the paper P.

The recording unit 5 faces the paper P that is attracted and held on the upper surface of the first belt conveying unit 41 and conveyed, and is arranged above the first belt conveying unit 41 by a specified interval. The recording unit 5 has a liquid ejection device 50 provided with a line-type inkjet liquid ejection head 51. As illustrated in FIG. 2, the liquid ejection device 50 includes liquid ejection devices 50B, 50C, 50M, and 50Y corresponding to each of the four colors black, cyan, magenta, and yellow. Similarly, the liquid ejection head 51 includes liquid ejection heads 51B, 51C, 51M, and 51Y corresponding to each of the four colors of black, cyan, magenta, and yellow.

As illustrated in FIG. 3, the liquid ejection head 51 has liquid ejection units 511 in the bottom portion. The liquid ejection units 511 are arranged along the paper width direction Dw. The liquid ejection units 511 are able to eject ink (liquid) over the entire recording area on the paper P. The recording unit 5 sequentially ejects ink from the four-color liquid ejection heads 51B, 51C, 51M, and 51Y toward the paper P conveyed by the first belt conveying unit 41. As a result, the recording unit 5 records a full-color image or a monochrome image on the paper P.

The drying unit 6 is arranged on the downstream side in the paper conveying direction of the recording unit 5, and a second belt conveying unit 42 is provided. The paper P on which the ink image is recorded by the recording unit 5 is attracted to and held by the second belt conveying unit 42 in the drying unit 6, and the ink is dried while being conveyed.

The overall control unit 7 includes a CPU, a storage unit, other electronic circuits, and electronic components. The CPU controls the operation of each component provided in the inkjet recording apparatus 1 based on a control program and data stored in the storage unit. As a result, the CPU performs processing related to the functions of the inkjet recording apparatus 1. Each of the paper supply unit 3, the paper conveying unit 4, the recording unit 5, and the drying unit 6 receives command individually from the overall control unit 7 and performs recording on the paper P in conjunction with each other. The storage unit is configured, for example, by a combination of a non-volatile storage device and a volatile storage device. Non-volatile storage device is a program ROM (Read Only Memory), data ROM, or the like. The volatile storage device is a RAM (Random Access Memory) or the like.

Figure 4:
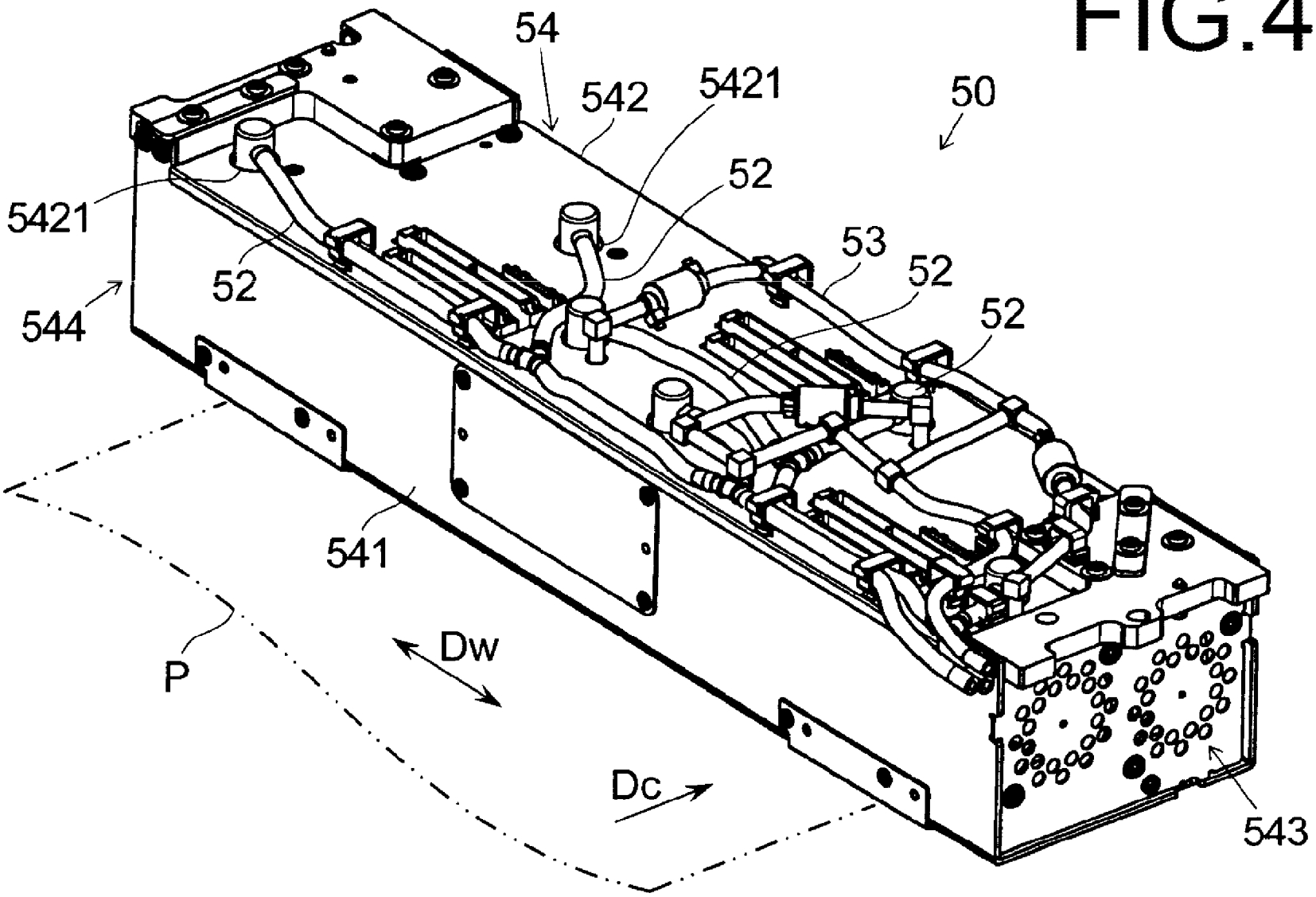
FIG. 4 is a perspective view of the liquid ejection device of the recording unit in FIG. 3 as viewed from above.
Figure 5:
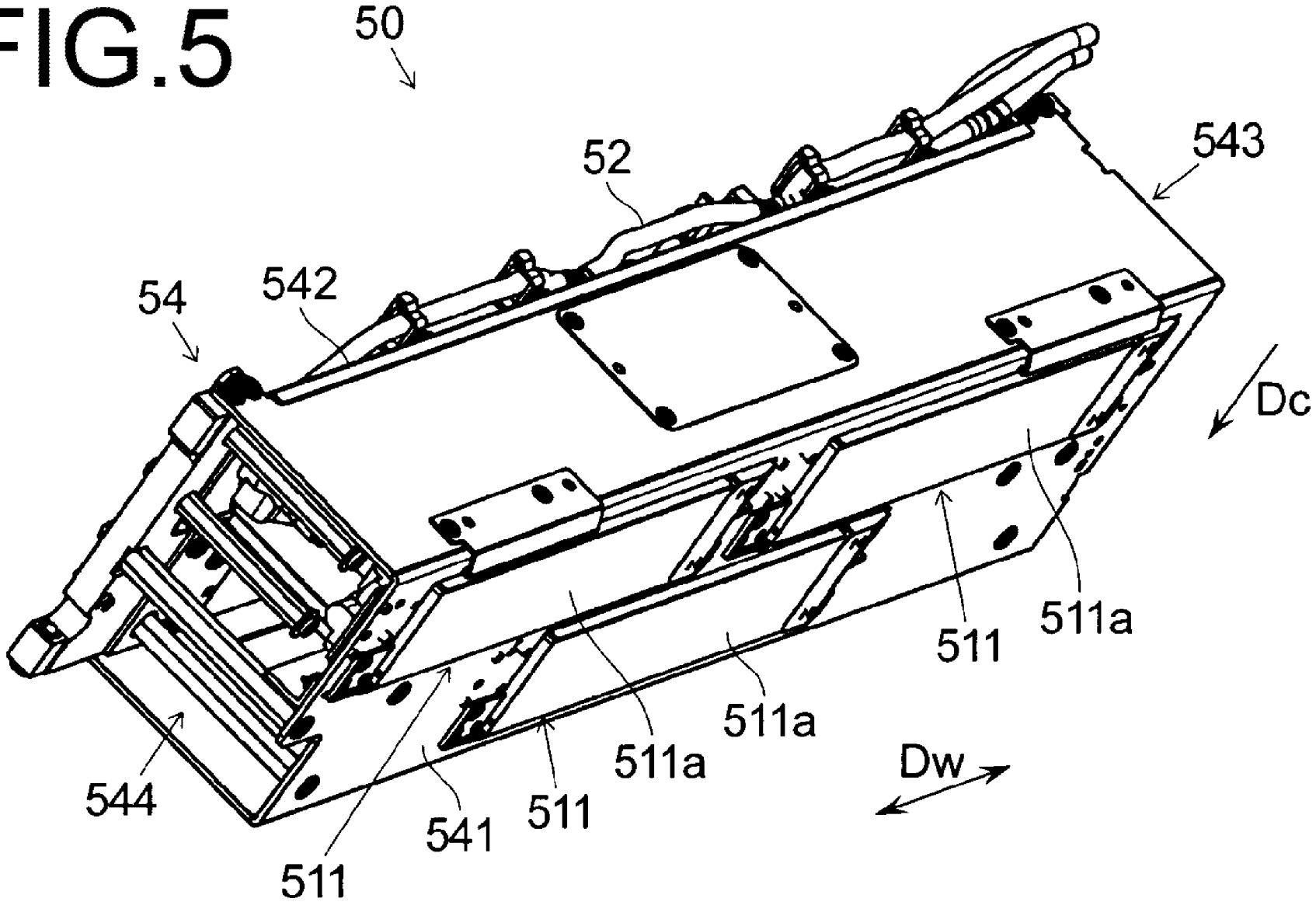
FIG. 5 is a perspective view of the liquid ejection device of the recording unit in FIG. 3 as viewed from below.
Figure 6:
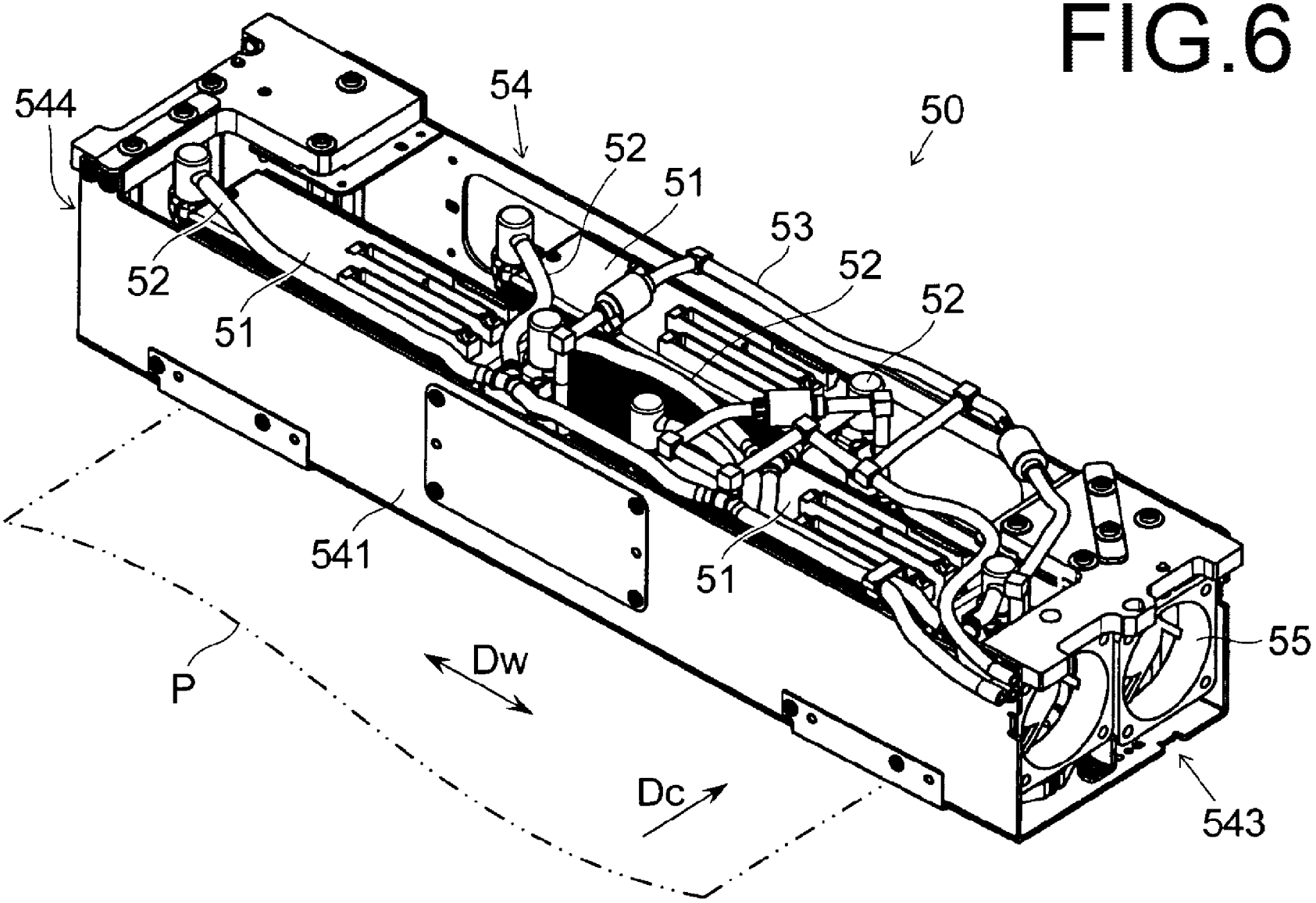
FIG. 6 is a perspective view of the liquid ejection device in FIG. 4, and illustrates a state in which the upper cover is removed.
Figure 7:
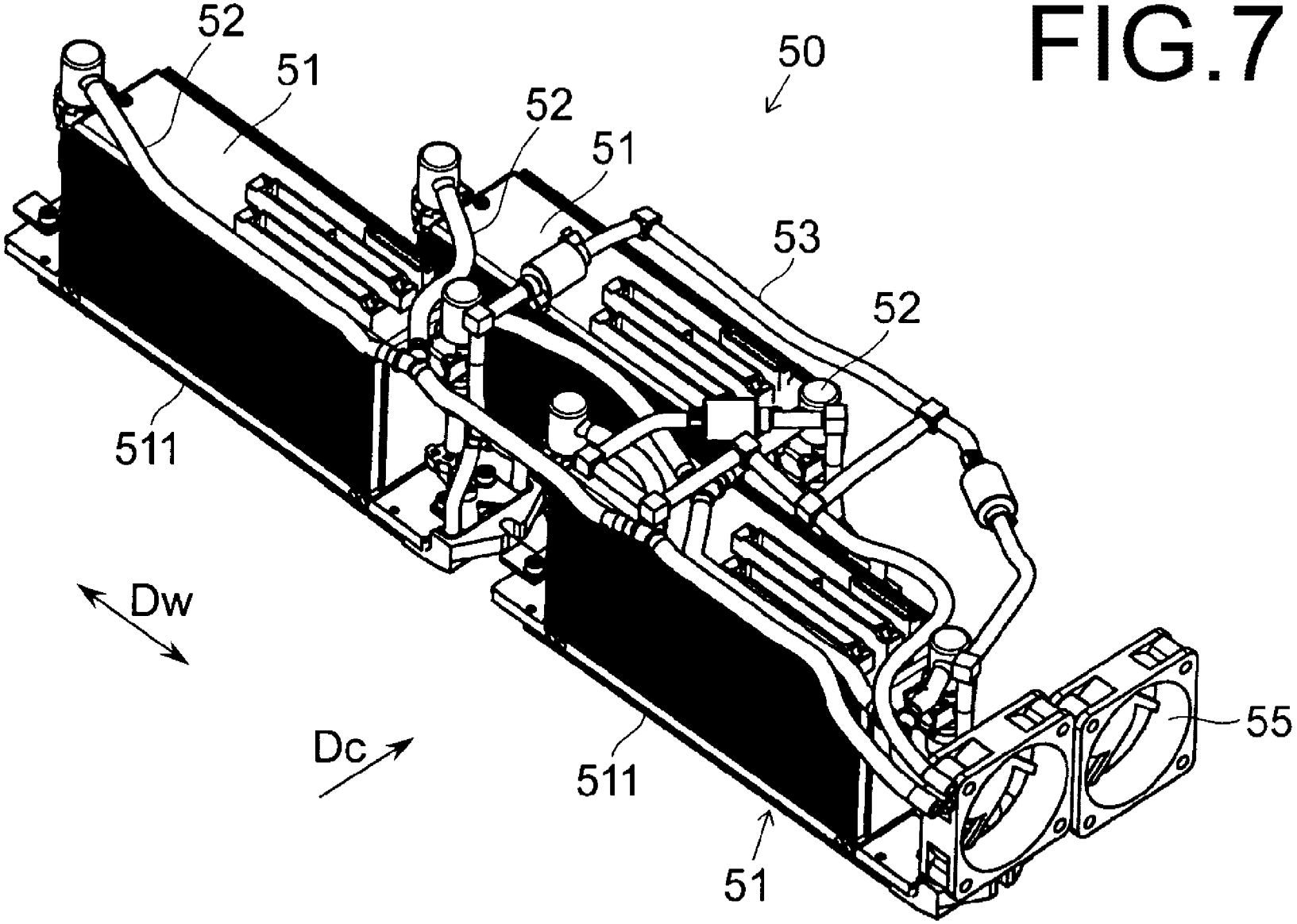
FIG. 7 is a perspective view of the liquid ejection device in FIG. 4, and illustrates a state in which the main housing is removed.
Figure 8:
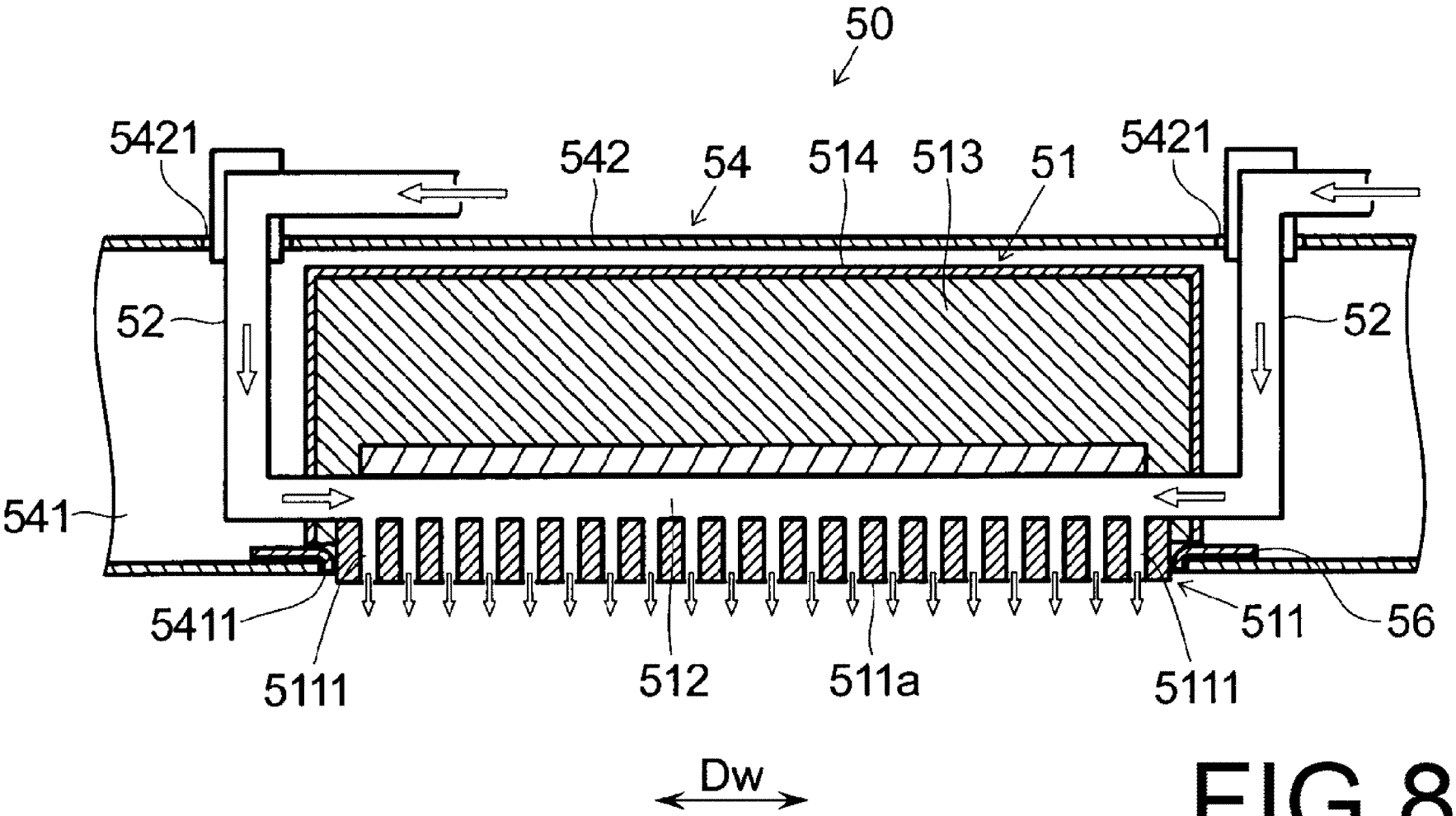
FIG. 8 is a vertical cross-sectional view of the liquid ejection head of the liquid ejection device in FIG. 7 as viewed from the paper conveying direction.

Next, the configuration of the liquid ejection device 50 of the inkjet recording apparatus 1 will be described with reference to FIGS. 4, 5, 6, 7, and 8 in addition to FIGS. 2 and 3. FIG. 4 is a perspective view of the liquid ejection device 50 of the recording unit 5 in FIG. 3 as viewed from above. FIG. 5 is a perspective view of the liquid ejection device 50 of the recording unit 5 in FIG. 3 as viewed from below. FIG. 6 is a perspective view of the liquid ejection device 50 in FIG. 4, and illustrates a state in which the upper cover 542 is removed. FIG. 7 is a perspective view of the liquid ejection device 50 in FIG. 4, and illustrates a state in which the main housing 54 is removed. FIG. 8 is a vertical cross-sectional view of the liquid ejection head 51 of the liquid ejection device 50 in FIG. 7 as viewed from the paper conveying direction Dc. The white arrows in FIG. 8 indicate the flow direction of the ink (liquid).

Note that the four-color liquid ejection devices 50B, 50C, 50M, and 50Y have the same shape and the same configuration. Therefore, the description will be made using one as a representative, and a description using the identification codes representing each color will be omitted.

The liquid ejection device 50 includes a liquid ejection head 51, a liquid supply path 52, a cleaning liquid supply path 53, a main housing 54, and a fan 55.

As illustrated in FIGS. 2, 6 and 7, a plurality (for example, three) of the liquid ejection heads 51 are provided in the main housing 54. Three liquid ejection heads 51 are arranged in a staggered pattern along, for example, the paper width direction Dw orthogonal to the paper conveying direction Dc.

As illustrated in FIGS. 5 and 8, the liquid ejection head 51 has a liquid ejection unit 511, a common passage 512, a control board 513, and a head housing 514.

The liquid ejection unit 511 is arranged in the lower portion of the liquid ejection head 51. The lower surface of the liquid ejection unit 511 is an ink ejection surface 511*a* through which a plurality of ink ejection nozzles 5111 open. The ink ejection surface 511*a* opposes and faces the paper P that is attracted to and held on the upper surface of the first belt conveying unit 41 and conveyed, and is parallel to the surface of the paper P. The liquid ejection unit 511 ejects ink (liquid) onto the paper P that is attracted to and held on the upper surface of the first belt conveying unit 41 and conveyed.

The liquid ejection unit 511 includes a plurality of ink ejection nozzles 5111 and a driving element of the ink ejection nozzles 5111. The plurality of ink ejection nozzles 5111 are arranged side by side on the ink ejection surface 511*a* along the paper width direction Dw. The plurality of ink ejection nozzles 5111 can eject (spray) ink over the entire recording area.

The common passage 512 is arranged above the liquid ejection unit 511. The common passage 512 is an ink passage extending parallel to the lower surface of the liquid ejection unit 511. Each of both ends in the ink flow direction of the common passage 512 is connected to two liquid supply paths 52, and ink flows in. The common passage 512 is connected to the upstream end in the ink flow direction of the ink ejection nozzles 5111, and supplies ink to the ink ejection nozzles 5111.

The control board 513 is arranged above the common passage 512. The control board 513 controls the operation of the liquid ejection unit 511. More specifically, the control board 513 controls the driving element of the liquid ejection unit 511 and controls the ink ejection operation from the ink ejection nozzles 5111. The control board 513 receives a control command related to the ink ejection operation from the overall control unit 7.

The head housing 514 has, for example, a rectangular parallelepiped box shape, and covers the common passage 512 and the control board 513 that are housed therein. The liquid ejection unit 511 is arranged at the lower part of the head housing 514. The liquid ejection unit 511 is exposed to the outside on the lower surface of the head housing 514.

The downstream end in the ink flow direction of the liquid supply path 52 is connected to the common passage 512. One common passage 512 is provided in one liquid ejection head 51. Two liquid supply paths 52 are connected to one common passage 512. One liquid supply path 52 is connected to one end side in the paper width direction Dw of the common passage 512. The other liquid supply path 52 is connected to the other end side in the paper width direction Dw of the common passage 512. The upstream end the ink flow direction of the liquid supply path 52 is connected to an ink tank. The liquid supply path 52 includes, for example, a tube and a connecting member that connects a plurality of tubes. The liquid supply path 52 supplies ink (liquid) to the liquid ejection head 51.

The downstream end in the cleaning liquid flow direction of the cleaning liquid supply path 53 is connected to the cleaning liquid supply unit. The cleaning liquid supply unit is provided on one end side in the paper width direction Dw of the liquid ejection unit 511. The cleaning liquid supply unit includes a cleaning liquid supply surface and a plurality of cleaning liquid supply ports. The cleaning liquid supply surface is adjacent in the paper width direction Dw to the ink ejection surface 511*a*. The plurality of cleaning liquid supply ports are opened on the cleaning liquid supply surface. The cleaning liquid supply ports supply the cleaning liquid to the cleaning liquid supply surface. The cleaning liquid is carried to the ink ejection surface 511*a* by a wiper and used for cleaning the ink ejection surface 511*a*.

The upstream end in the cleaning liquid flow direction of the cleaning liquid supply path 53 is connected to the cleaning liquid tank. The cleaning liquid supply path 53 includes, for example, a tube and a connecting member that connects a plurality of tubes. The cleaning liquid supply path 53 supplies the cleaning liquid to the cleaning liquid supply unit of the liquid ejection head 51.

The main housing 54 extends along the paper width direction Dw and has a tubular shape with a rectangular cross section when viewed from the paper width direction Dw. The lower surface of the main housing 54 opposes and faces the paper P that is attracted to and held on the upper surface of the first belt conveying unit 41 and conveyed, and is parallel to the surface of the paper P.

The main housing 54 includes a gutter-shaped member 541 with openings at the upper end portion and both end portions in the paper width direction Dw, and an upper cover 542 that covers the opening at the upper end portion of the gutter-shaped member 541. Moreover, the main housing 54 has an intake port 543 and an exhaust port 544. The intake port 543 is arranged at one end portion in the paper width direction Dw. The exhaust port 544 is arranged at the other end portion in the paper width direction Dw.

The main housing 54 houses and holds three liquid ejection heads 51 inside. Note that each of the liquid ejection units 511 of the three liquid ejection heads 51 projects outward on the lower surface of the main housing 54. In other words, more specifically, the main housing 54 covers and accommodates the liquid ejection head 51 other than the liquid ejection unit 511 inside thereof.

The fan 55 is arranged at the intake port 543 of the main housing 54. For example, two fans 55 are arranged side by side along the paper conveying direction Dc. The fan 55 sucks in the air outside the main housing 54 and feeds the air into the main housing 54. Furthermore, the fan 55 circulates air between the main housing 54 and the head housing 514. As a result, the control board 513 of the liquid ejection head 51 may be cooled via the head housing 514.

Figure 9:
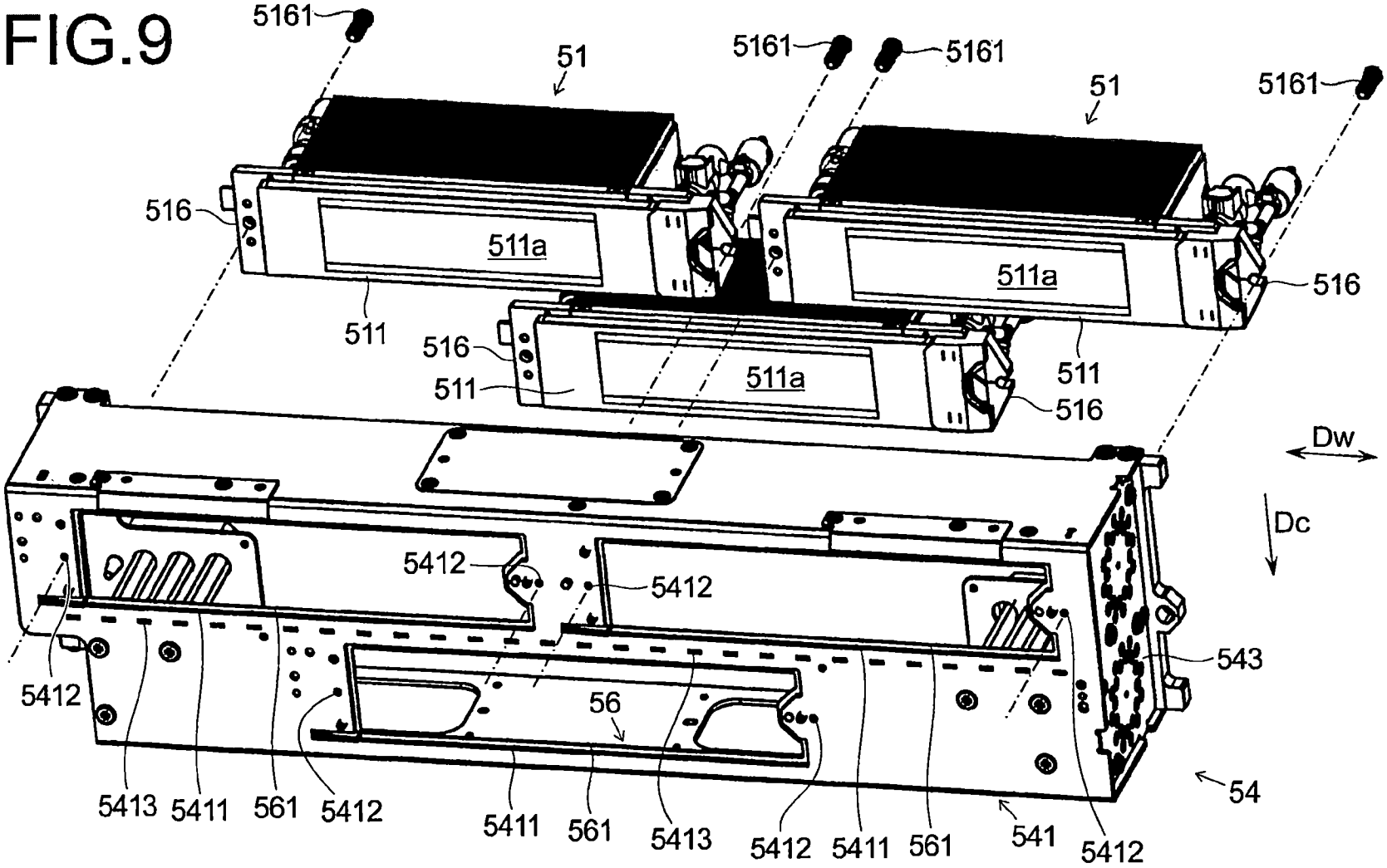
FIG. 9 is an exploded perspective view illustrating an installation structure of the liquid ejection head of the liquid ejection device in FIG. 6.
Figure 10:
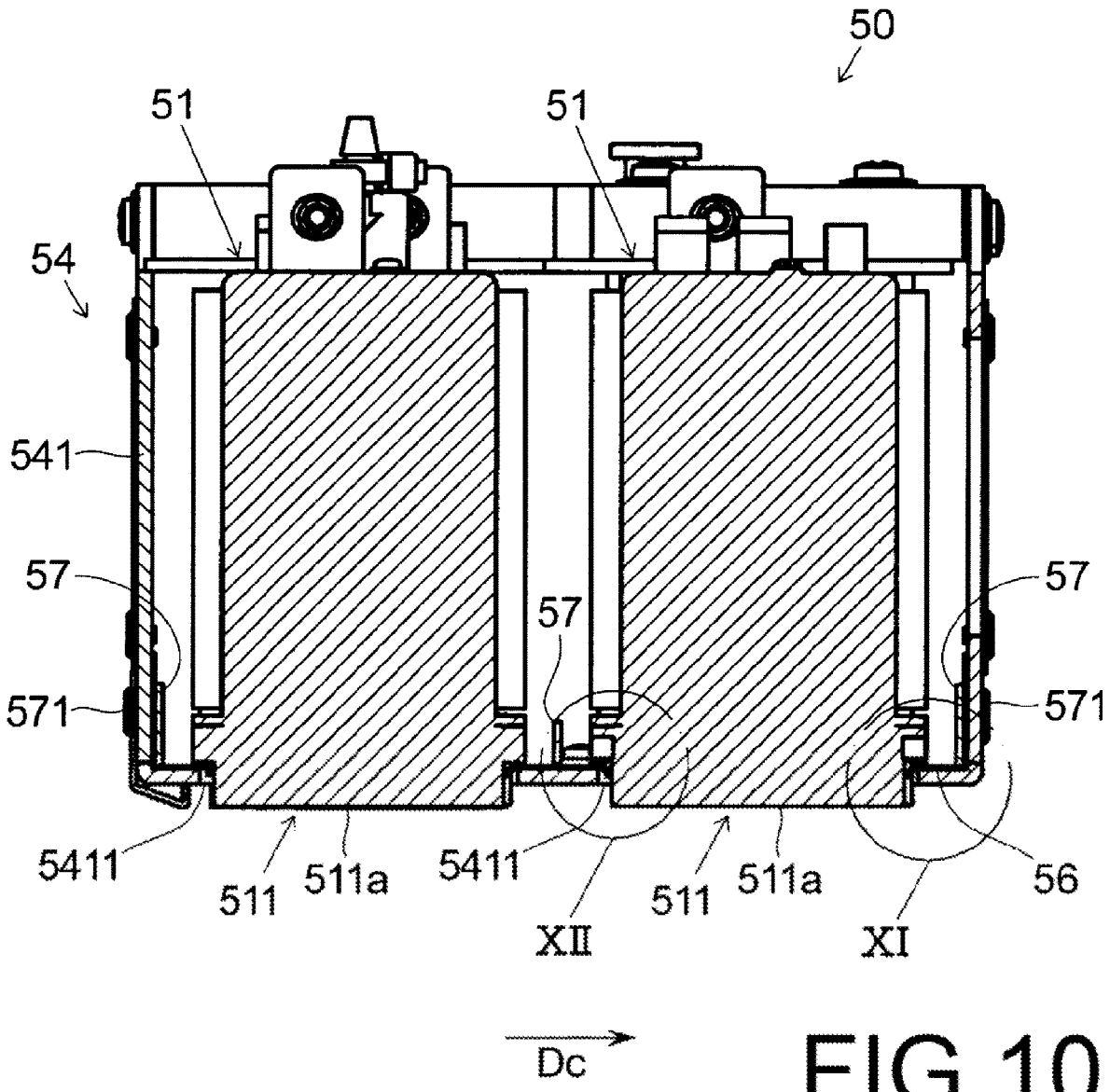
FIG. 10 is a vertical cross-sectional view of the liquid ejection device in FIG. 6 as viewed from the paper width direction.
Figure 11:
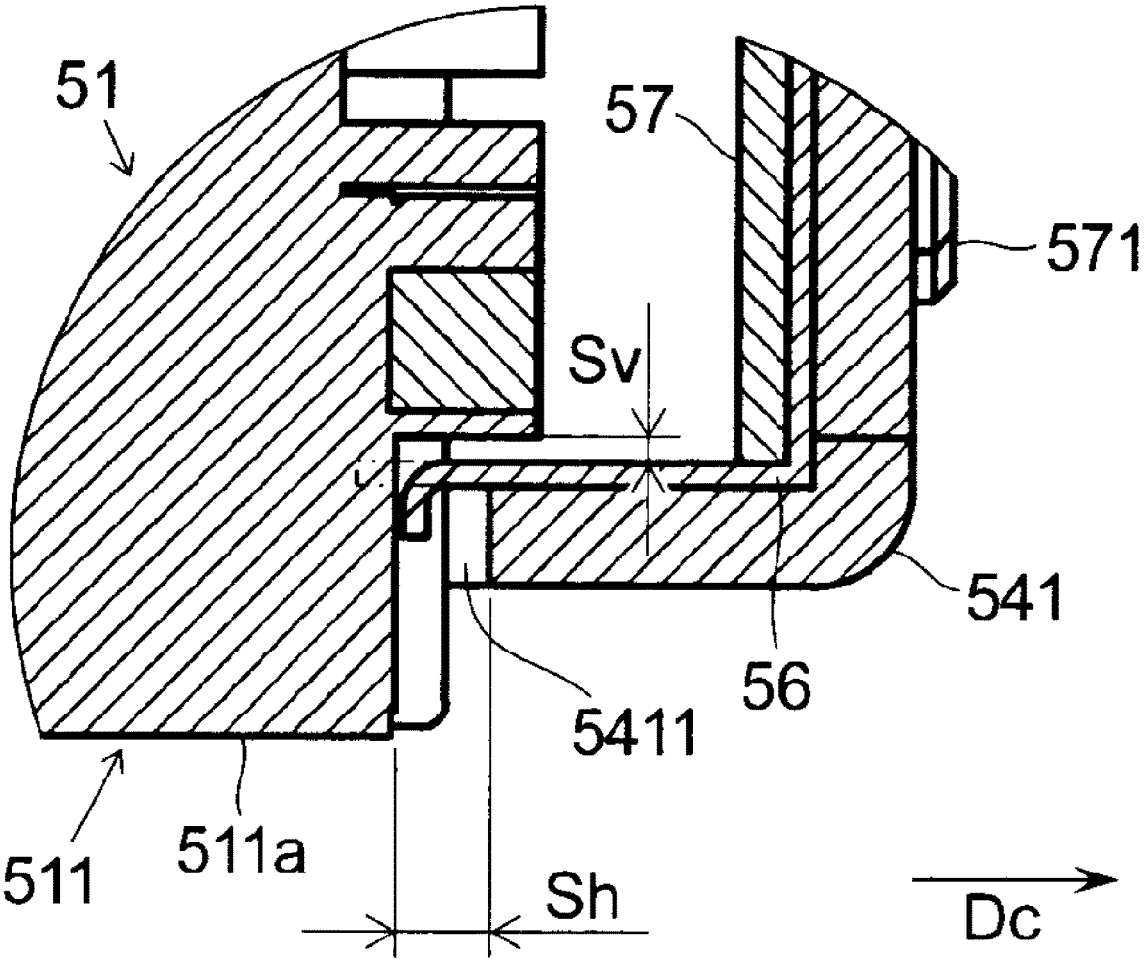
FIG. 11 is a partially enlarged vertical cross-sectional view of the liquid ejection device in FIG. 10.
Figure 12:
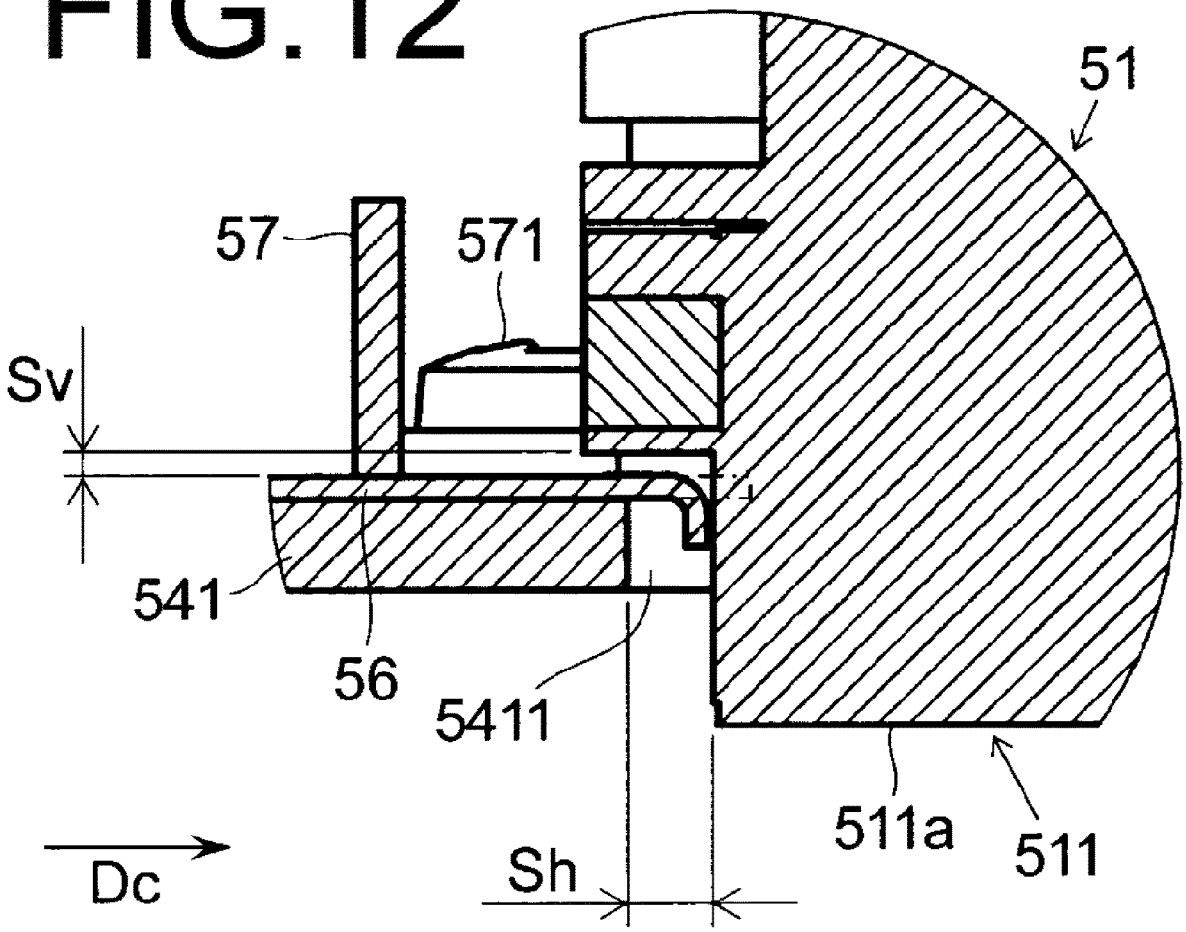
FIG. 12 is a partially enlarged vertical cross-sectional view of the liquid ejection device in FIG. 10.
Figure 13:
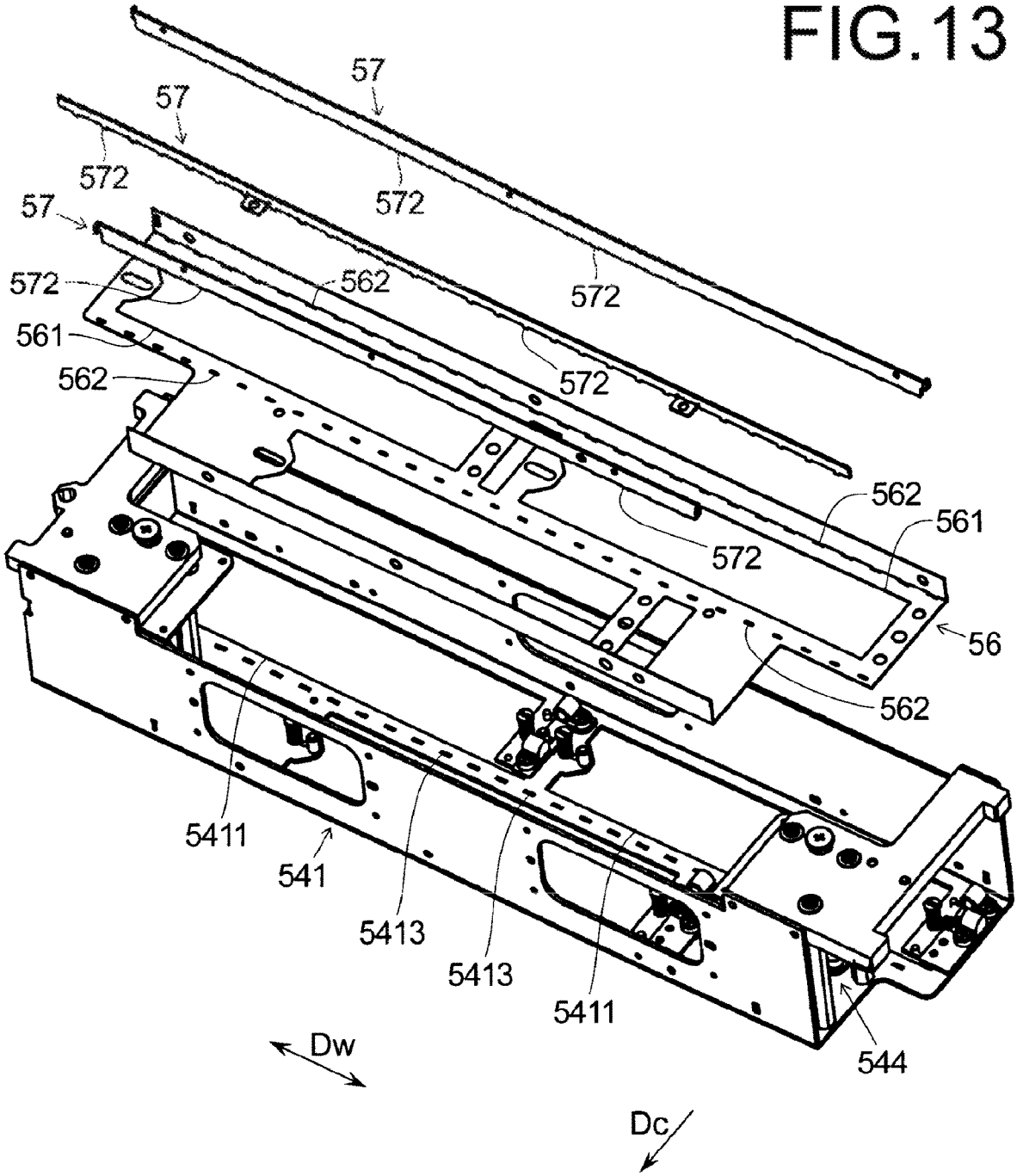
FIG. 13 is an exploded perspective view illustrating an installation structure of a sealing member of the liquid ejection device in FIG. 10.

Next, the configuration around the main housing 54 of the liquid ejection device 50 will be described with reference to FIGS. 9, 10, 11, 12, and 13. FIG. 9 is an exploded perspective view illustrating an installation structure of the liquid ejection head of the liquid ejection device in FIG. 6. FIG. 10 is a vertical cross-sectional view of the liquid ejection device in FIG. 6 as viewed from the paper width direction. FIGS. 11 and 12 are partially enlarged vertical cross-sectional view of the liquid ejection device in FIG. 10. FIG. 13 is an exploded perspective view illustrating an installation structure of a sealing member of the liquid ejection device in FIG. 10. Note that FIG. 11 is an enlarged view of the inside of the circle XI in FIG. 10. FIG. 12 is an enlarged view of the inside of the circle XII in FIG. 10.

The gutter-shaped member 541 of the main housing 54 has an ejection unit protrusion opening 5411 as illustrated in FIGS. 9 and 10. The ejection unit protrusion opening 5411 is arranged at the bottom portion of the gutter-shaped member 541. More specifically, the ejection unit protrusion opening 5411 is arranged at a position below the liquid ejection unit 511 of the liquid ejection head 51 and overlapping the liquid ejection unit 511 when viewed in the vertical direction.

A total of three ejection unit protrusion openings 5411 are provided below the liquid ejection units 511 of the three liquid ejection heads 51, respectively. In other words, the main housing 54 has the same number of three ejection unit protrusion openings 5411 as the three liquid ejection heads 51. The ejection unit protrusion opening 5411 has a substantially rectangular shape extending in the paper width direction Dw. The ejection unit protrusion opening 5411 penetrates the gutter-shaped member 541 in the vertical direction.

The liquid ejection unit 511 of the liquid ejection head 51 is inserted downward into the ejection unit protrusion opening 5411. The liquid ejection unit 511 is arranged inside the gutter-shaped member 541. The liquid ejection unit 511 projects downward from the lower surface of the gutter-shaped member 541.

The size of the ejection unit protrusion opening 5411 is larger than the size of the outer shape of the liquid ejection unit 511 that is inserted into the ejection unit protrusion opening 5411. A gap Sh (see FIGS. 11 and 12) is provided between the liquid ejection unit 511 and the ejection unit protrusion opening 5411 in the entire surrounding area in the horizontal direction around the liquid ejection unit 511. In other words, the main housing 54 has an ejection unit protrusion opening 5411 in which the liquid ejection unit 511 is inserted and protrudes downward through the gap Sh in the horizontal direction.

As shown in FIG. 9, the liquid ejection head 51 has mounting portions 516 and mounting screws 5161. The mounting portions 516 are provided at each of both end portions of the liquid ejection head 51 in the paper width direction Dw. One mounting portion 516 has a hole that is circular when viewed from the vertical direction and in which the mounting screw 5161 is inserted. The other mounting portion 516 has a U-shaped groove in which the mounting screw 5161 is inserted when viewed from the vertical direction.

The gutter-shaped member 541 has screw holes 5412. The screw holes 5412 are arranged in the vicinity near each of both end portions in the paper width direction Dw of the ejection unit protrusion opening 5411 of the bottom portion of the gutter-shaped member 541. The screw holes 5412 are arranged so as to be separated on the outside from the edge portion of the ejection unit protrusion opening 5411. The screw holes 5412 face in the vertical direction the mounting portions 516 of the liquid ejection head 51.

The liquid ejection head 51 is such mounting screws 5161 are fastened to the screw holes 5412 via the mounting portions 516. As a result, the liquid ejection head 51 is mounted to the gutter-shaped member 541 of the main housing 54. Note that the mounting screw 5161 is fastened to the screw hole 5412 via a coil portion of a compression coil spring arranged between the mounting screw 5161 and the mounting portion 516. As a result, the liquid ejection head 51 may be pressed downward toward the gutter-shaped member 541 by utilizing the elastic force of the compression coil spring.

The liquid ejection device 50 includes a sealing member 56, as illustrated in FIGS. 9, 11 and 12. The sealing member 56 is arranged adjacent to the inner bottom surface of the gutter-shaped member 541. As illustrated in FIGS. 9 and 13, the sealing member 56 has an ejection unit insertion opening 561.

The ejection unit insertion opening 561 faces in the vertical direction the ejection unit protrusion opening 5411 of the gutter-shaped member 541. The liquid ejection unit 511 is inserted into the ejection unit insertion opening 561. The sealing member 56 comes in contact with the outer peripheral portion of the liquid ejection unit 511 that is inserted into the ejection unit insertion opening 561 and covers the gap Sh in the horizontal direction.

As illustrated in FIG. 9, the size of the ejection unit insertion opening 561 before assembly is smaller than the size of the ejection unit protrusion opening 5411. More specifically, the ejection unit insertion opening 561 is housed in the ejection unit protrusion opening 561 in the plane in which the ejection unit protrusion opening 5411 is open. In other words, with respect to the entire periphery of the edge portion of the ejection unit protrusion opening 5411, the sealing member 56 protrudes inside the ejection unit protrusion opening 5411, and the ejection unit insertion opening 561 is arranged in the protruding portion.

Furthermore, the size of the ejection unit insertion opening 561 in the natural state before being assembled, or in other words, in the non-bent state, is smaller than the size of the outer shape portion of the liquid ejection unit 511 that is inserted into the ejection unit insertion opening 561. Therefore, when the liquid ejection unit 511 is inserted into the ejection unit insertion opening 561, as illustrated in FIGS. 11 and 12, the sealing member 56 comes in contact with the outer peripheral portion of the liquid ejection portion 511 with the edge portion of the ejection unit insertion opening 561 bent. In other words, in each direction parallel to the plane in which the ejection unit protrusion opening 5411 is open, the width of the ejection portion insertion port 561 in the natural state before assembly is less than the width of the portion of the ejection unit protrusion opening 5411 that the edge portion of the ejection unit insertion opening 561 comes in contact with after assembly. Note that even in the assembled state, the size of the ejection unit insertion opening 561 is smaller than the size of the ejection unit protrusion opening 5411.

With the configuration described above, the liquid ejection unit 511 of the liquid ejection head 51 is inserted into the ejection unit protrusion opening 5411 of the main housing 54 through the gap Sh in the horizontal direction. As a result, the position adjustment allowance of the liquid ejection head 51 with respect to the main housing 54 can be maintained. Furthermore, the sealing member 56 comes in contact with the outer peripheral portion of the liquid ejection unit 511 in a state where the edge portion of the ejection unit insertion opening 561 is bent. Therefore, it is possible to improve the sealing property of the gap between the main housing 54 and the liquid ejection head 51. Then, even when executing position adjustment of the liquid ejection head 51 with respect to the main housing 54, the sealing member 56 may be kept in contact with the outer peripheral portion of the liquid ejection unit 511. When the edge portion of the ejection unit insertion opening 561 is in close contact with the outer peripheral portion of the liquid ejection unit 511, the sealing property may be further improved.

A part of the sealing member 56 is arranged on the edge portion of the ejection unit protrusion opening 5411. This portion is referred to as the upper edge of the sealing member 56. As illustrated in FIGS. 11 and 12, the liquid ejection head 51 is arranged above the entire periphery of the edge portion of the ejection unit protrusion opening 5411 and separated from the upper edge portion of the sealing member 56. In other words, the liquid ejection head 51 may have an overhanging portion that projects above the liquid ejection head 511 horizontally with respect to the liquid ejection unit 511. In this case, the overhanging portion is arranged above the edge portion of the ejection unit protrusion opening 5411 via a gap Sv in the vertical direction with respect to the upper edge portion of the sealing member 56. Moreover, the overhanging portion such as described above does not have to be in the liquid ejection head 51 above the edge portion of the ejection unit protrusion opening 5411.

In other words, either there is a state of no overhanging portion above the upper edge portion of the sealing member 56 over the entire periphery of the edge portion of the ejection unit protrusion opening 5411, or there is a state of an overhanging portion in the vertical direction via the gap Sv. That is, the liquid ejection head 51 is not in contact with the sealing member 56 arranged above the edge portion of the ejection unit protrusion opening 5411.

With this configuration, the liquid ejection head 51 does not come into contact with the sealing member 56 in the vertical direction near the edge portion of the ejection unit protrusion opening 5411, and there is no obstacle to vertical movement of the liquid ejection head 51. As a result, height adjustment of the liquid ejection head 51 may be easily performed by moving the mounting portion 516 of the liquid ejection head 51 up and down.

The sealing member 56 is in a state of being bent downward over the entire periphery of the edge portion of the ejection unit insertion opening 561. The sealing member 56 is bent in the same direction over the entire periphery of the edge portion of the ejection unit insertion opening 561. As a result, the sealing property is higher than in a case where there is a place where the bending direction changes. The bending direction may also be upward over the entire periphery.

One sealing member 56 is provided for one liquid ejection device 50. The sealing member 56 has three ejection unit insertion openings 561. In other words, one sealing member 56 is provided for the three liquid ejection heads 51 and the three ejection unit protrusion openings 5411. With this configuration, the sealing member 56 may be provided in a small space for each of the three liquid ejection heads 51 and the three ejection unit protrusion openings 5411. Therefore, the sealing property of the gap between the three liquid ejection heads 51 and the main housing 54 may be improved. Furthermore, it is possible to reduce the size of the liquid ejection device 50. Moreover the number of parts may be reduced, and the assembly man-hours may be reduced.

In addition, the sealing member 56 is made of a flexible material such as EPDM (ethylene propylene diene rubber). EPDM is strong against ink and does not undergo a chemical change or the like even when ink adheres. In addition, EPDM may be obtained at a low cost, and the cost of the liquid ejection device 50 may be reduced. The sealing member 56 is thin so that it may be bent. Therefore, in a case where the liquid ejection unit 511 is inserted into the ejection unit insertion opening 561 of the sealing member 56, the edge portion of the ejection unit insertion opening 561 comes into contact with the liquid ejection unit 511 in a bent state. Moreover since the sealing member 56 has flexibility, the edge portion of the ejection unit insertion opening 561 is brought into close contact with the outer peripheral portion of the liquid ejection unit 511.

The liquid ejection device 50 includes a holder member 57 as shown in FIGS. 10, 11, 12, and 13. The holder member 57 is arranged inside the sealing member 56 adjacent to the sealing member 56 arranged on the inner bottom surface of the gutter-shaped member 541.

Three holder members 57 are provided. Two holder members 57 are arranged along the side wall extending in the paper width direction Dw at each of the upstream end and the downstream end of the paper conveying direction Dc inside the gutter-shaped member 541. The remaining one holder member 57 is arranged between the liquid ejection heads 51 arranged in the paper conveying direction Dc.

The holder member 57 is a thin plate-shaped member extending along the paper width direction Dw and the vertical direction. The holder member 57 is attached to the gutter-shaped member 541 using screws 571. The holder member 57 holds and fixes the sealing member 56 between the holder member 57 and the gutter-shaped member 541 of the main housing 54.

As illustrated in FIG. 13, the holder member 57 has a plurality of protrusions 572. The plurality of protrusions 572 are provided at the lower end of the holder member 57 and are arranged at specified intervals along the paper width direction Dw. The plurality of protrusions 572 project downward, or in other words, toward the sealing member 56 and the gutter-shaped member 541 of the main housing 54.

The sealing member 56 has a plurality of protrusion insertion holes 562. The plurality of protrusion insertion holes 562 are provided on the flat surface portion of the sealing member 56 extending in the horizontal direction adjacent to the inner bottom surface of the gutter-shaped member 541. The plurality of protrusion insertion holes 562 are provided in the vicinity of each of the side walls of the gutter-shaped member 541 extending in the paper width direction Dw at each of the upstream end and the downstream end in the paper conveying direction Dc, and arranged between the liquid ejection heads 51 arranged in the paper conveying direction Dc. The plurality of protrusion insertion holes 562 penetrate through the sealing member 56 in the vertical direction. The plurality of protrusion insertion holes 562 face each of the protrusions 572 of the three holder members 57 in the vertical direction, and are arranged at specified intervals along the paper width direction Dw. Each of the plurality of protrusions 572 is individually inserted into the plurality of protrusion insertion holes 562.

The gutter-shaped member 541 has a plurality of protrusion insertion holes 5413. The plurality of protrusion insertion holes 5413 are provided on the inner bottom surface of the gutter-shaped member 541 and are arranged between the liquid ejection heads 51 arranged in the paper conveying direction Dc. The plurality of protrusion insertion holes 5413 penetrate through the gutter-shaped member 541 in the vertical direction. The plurality of protrusion insertion holes 5413 face in the vertical direction the protrusions 572 of one holder member 57 arranged between the liquid ejection heads 51 arranged in the paper conveying direction Dc, and are arranged at specified intervals along the paper width direction Dw. Each of the plurality of protrusions 572 is individually inserted into the plurality of protrusion insertion holes 5413.

With this configuration, the plurality of protrusions 572 of the holder member 57 are individually inserted into the plurality of protrusion insertion holes 562 of the sealing member 56 and the plurality of protrusion insertion holes 5413 of the main housing 54. Thereby, the strength related to the fixing of the sealing member 56 may be increased. Therefore, misalignment of the sealing member 56 may be suppressed. Therefore, it is possible to improve the sealing property of the gap between the main housing 54 and the liquid ejection head 51.

Moreover, according to the above embodiment described above, the inkjet recording apparatus 1 uses the liquid ejection device 50 having the above configuration to eject ink onto the paper P to record an image. As a result, in the inkjet recording apparatus 1, the position adjustment allowance of the liquid ejection head 51 with respect to the main housing 54 may be secured. Furthermore, in the inkjet recording apparatus 1, it is possible to improve the sealing property of the gap between the main housing 54 and the liquid ejection head 51.

To summarize the above, in a case of a typical technique, the air flow generated by the operation of the fan motor may pass through a gap or the like between the drive circuit board and the housing. Therefore, there is a possibility that this air flow may reach the location of the nozzles for ejecting ink. As a result, the air flow may affect the ejection of ink from the nozzles. Therefore, there is a problem in that the landing of the ink is misaligned.

On the other hand, a technique has been proposed in which a portion of the head other than the nozzle portion is covered and housed in a housing, and air flow is allowed in the housing. In this case, it is necessary to prevent the air flow from reaching the nozzle portion. In order for this, it is desirable that there is no gap between the head and the housing at a location where the nozzle portion of the head protrudes from the inside of the housing to the outside. However, when the head is arranged without a gap with respect to the housing, it becomes impossible to adjust the position such as the height and inclination of the head with respect to the housing.

On the other hand, the technique according to the present disclosure makes it possible to improve the sealing property of the gap between the main housing and the liquid ejection head while ensuring the position adjustment allowance of the liquid ejection head with respect to the main housing.

In other words, with configuration of the present disclosure, the liquid ejection unit of the liquid ejection head is inserted into to the ejection unit protrusion opening of the main housing through a gap in the horizontal direction. As a result, the position adjustment allowance of the liquid ejection head with respect to the main housing may be secured. Furthermore, the sealing member comes into contact with the outer peripheral portion of the liquid ejection unit in a state in which the edge portion of the ejection unit insertion opening is bent, so it is possible to improve the sealing property of the gap between the main housing and the liquid ejection head. Then, even in a case where executing position adjustment of the liquid ejection head with respect to the main housing, the sealing member may be kept in contact with the outer peripheral portion of the liquid ejection unit.

Although the embodiments of the present disclosure have been described above, the scope of the present disclosure is not limited to this, and various modifications may be added and performed without departing from the gist of the invention.

What is claimed is:

1. A liquid ejection device, comprising:

one or more liquid ejection heads having a liquid ejection unit that ejects liquid onto a recording medium;

a main housing having one or more ejection unit protrusion openings into which the liquid ejection unit is inserted downward and protrudes through a gap in a horizontal direction, and covers and internally houses a portion of the one or more liquid ejection heads other than the liquid ejection unit;

one or more sealing members having an ejection unit insertion opening into which the liquid ejection unit is inserted, and that comes in contact with an outer peripheral portion of the liquid ejection unit to close the gap in the horizontal direction; and a fan that allows air to flow between the main housing and the one or more liquid ejection heads; wherein a size of the ejection unit insertion opening is smaller than a size of the one or more ejection unit protrusion openings; and the liquid ejection unit ejects liquid onto the recording medium in a state where the one or more sealing members comes in contact with an outer peripheral portion of the liquid ejection unit in a state where an edge portion of the ejection unit insertion opening is bent.

2. The liquid ejection device according to claim 1, wherein a part of the one or more sealing members is arranged on an edge portion of the one or more ejection unit protrusion openings; and the one or more liquid ejection heads are not in contact with a portion of the one or more sealing members arranged on an edge portion of the one or more ejection unit protrusion openings.

3. The liquid ejection device according to claim 1, wherein a part of the one or more sealing members is arranged on an edge portion of the one or more ejection unit protrusion openings;

the one or more liquid ejection heads have an overhanging portion above an edge portion of the one or more ejection unit protrusion opening, and projects in a horizontal direction with respect to the liquid ejection unit; and the overhanging portion is arranged via a gap in a vertical direction with respect to a portion of the one or more sealing members arranged on an edge portion of the one or more ejection unit protrusion openings.

4. The liquid ejection device according to claim 1, further comprising a holder member that sandwiches and fixes the one or more sealing members with the main housing; wherein the holder member has a plurality of protrusions that project toward the one or more sealing members and the main housing; and the one or more sealing members and the main housing have a plurality of protrusion insertion holes into which the plurality of protrusions are individually inserted.

5. The liquid ejection device according to claim 1, further wherein the one or more liquid ejection heads is a plurality of liquid ejection heads;

the one or more ejection unit protrusion openings is a plurality of ejection unit protrusion openings;

the main housing has a same number of the plurality of ejection unit protrusion openings as the plurality of liquid ejection heads; and one sealing member is provided for the plurality of liquid ejection heads and the plurality of ejection unit protrusion openings.

6. The liquid ejection device according to claim 1, wherein the one or more sealing members are made of EPDM.

7. An inkjet recording apparatus that records an image by ejecting ink onto a recording medium using the liquid ejection device according to claim 1.

8. The liquid ejection device according to claim 1, wherein the outer peripheral portion of the liquid ejection unit in contact with the one or more sealing members is a side surface extending upward from an ink ejection surface, which is a surface for ejecting the liquid of the liquid ejection unit.

* * * * *